US008861173B2

(12) United States Patent
Ikeda et al.

(10) Patent No.: US 8,861,173 B2
(45) Date of Patent: Oct. 14, 2014

(54) MIXER, MATCHING DEVICE, IGNITION UNIT, AND PLASMA GENERATOR

(75) Inventors: Yuji Ikeda, Kobe (JP); Minoru Makita, Kobe (JP); Ahsa Moon, Kobe (JP)

(73) Assignee: Imagineering, Inc., Hyogo (JP)

( * ) Notice: Subject to any disclaimer, the term of this patent is extended or adjusted under 35 U.S.C. 154(b) by 429 days.

(21) Appl. No.: 13/389,184

(22) PCT Filed: Aug. 6, 2010

(86) PCT No.: PCT/JP2010/063432

§ 371 (c)(1),
(2), (4) Date: Mar. 29, 2012

(87) PCT Pub. No.: WO2011/016569

PCT Pub. Date: Feb. 10, 2011

(65) Prior Publication Data

US 2012/0176723 A1 Jul. 12, 2012

(30) Foreign Application Priority Data

Aug. 6, 2009 (JP) ..... 2009-198943

(51) Int. Cl.

| | |
|---|---|
| ***F23Q 3/00*** | (2006.01) |
| ***H05H 1/36*** | (2006.01) |
| ***H05H 1/46*** | (2006.01) |
| ***F02P 9/00*** | (2006.01) |
| ***F02P 3/01*** | (2006.01) |
| ***H05H 1/52*** | (2006.01) |
| *F02P 23/04* | (2006.01) |

(52) U.S. Cl.

CPC *H05H 1/36* (2013.01); *F02P 23/04* (2013.01); *H05H 1/46* (2013.01); *F02P 9/007* (2013.01); *F02P 3/01* (2013.01); *H05H 1/52* (2013.01); *H05H 2001/4682* (2013.01)

USPC ..... 361/253

(58) Field of Classification Search

CPC ..... F23Q 5/00; F02P 1/00; F02P 3/00
USPC ..... 361/253
See application file for complete search history.

(56) References Cited

U.S. PATENT DOCUMENTS 4,138,980 A 2/1979 Ward
8,420,021 B2 * 4/2013 Makita et al. ..... 422/186.21

(Continued)

FOREIGN PATENT DOCUMENTS

JP 51-077719 A 7/1976
JP 60-098167 A 6/1985
JP 64-036981 A 2/1989
JP 2007-113570 A 5/2007

(Continued)

OTHER PUBLICATIONS

International Search Report of PCT/JP2010/063432, mailing date Nov. 2, 2010.

*Primary Examiner* — Dharti Patel
(74) *Attorney, Agent, or Firm* — Westerman, Hattori, Daniels & Adrian, LLP

(57) ABSTRACT

A mixer for mixing pulse voltage energy and electromagnetic wave energy in the same transmission line is provided with a first input terminal to which an electromagnetic wave is inputted, a second input terminal to which pulse voltage is inputted, a mixing output terminal from which the pulse voltage and the electromagnetic wave are outputted, a bar-shaped first conductive member of which one end is electrically connected to the second input terminal and the other end is electrically connected to an inner conductor of the mixing output terminal, a cylindrical second conductive member which surrounds the first conductive member with a gap therebetween and is disposed coaxially with the first conductive member and electrically connected to an inner conductor of the first input terminal, and a cylindrical third conductive member which houses the first conductive member and the second conductive member with a gap between the second conductive member and the third conductive member and is disposed coaxially with the first conductive member and the second conductive member and electrically connected to an outer conductor of the first input terminal and an outer conductor of the mixing output terminal.

18 Claims, 7 Drawing Sheets

(56) References Cited

U.S. PATENT DOCUMENTS

| | | | | |
|---|---|---|---|---|
| 8,442,746 | B2 * | 5/2013 | Ando et al. | 701/111 |
| 2007/0125341 | A1 * | 6/2007 | Tamamoto et al. | 123/406.23 |
| 2010/0196208 | A1 * | 8/2010 | Makita et al. | 422/83 |
| 2011/0030347 | A1 * | 2/2011 | Ikeda | 60/275 |

FOREIGN PATENT DOCUMENTS

| | | | |
|---|---|---|---|
| JP | 2009-036198 | A | 2/2009 |
| JP | 2009-038026 | A | 2/2009 |
| WO | 2008/113956 | A2 | 9/2008 |
| WO | 2009/008518 | A1 | 1/2009 |

* cited by examiner

MIXER, MATCHING DEVICE, IGNITION UNIT, AND PLASMA GENERATOR

BACKGROUND OF THE INVENTION

1. Field of the Invention

The present invention relates to a mixer for mixing a pulse voltage and an electromagnetic wave, a matching device for achieving impedance matching of an electromagnetic wave output from the mixer, an ignition unit having the mixer, and a plasma generator having the ignition unit.

2. Related Art

As an alternative method of spark ignition of an internal-combustion engine or a plasma generation method, a technology of generating plasma by using spark discharge and electromagnetic wave radiation together is proposed. Compared with the case in which only an electromagnetic wave is used to generate the plasma, the technology may decrease required energy of the electromagnetic wave for generating the plasma. Patent Document 1 records a plasma generator, in which an antenna is configured near a discharge electrode of a spark plug. In addition, Patent Document 1 and Patent Document 2 record a spark plug configured with a transmission line and an antenna of an electromagnetic wave.

Patent Document 3 records a plasma generation device, which enables energy for discharging and energy of an electromagnetic wave to overlap on the same transmission line at a front section of a spark plug. Moreover, Patent Document 4 records a device, which is not a device for generating plasma, but combines a direct current (DC) voltage and microwave energy with a coaxial conductor, which are conducted into a combustion chamber to combine the microwave energy with a plasma mixture (a flame) in combustion.

PRIOR ART DOCUMENTS

Patent Documents

Patent Document 1: Japanese Laid-open Patent Publication No. 2007-113570

Patent Document 2: Japanese Laid-open Patent Publication No. 2009-38026

Patent Document 3: Japanese Laid-open Patent Publication No. 2009-36198

Patent Document 4: Japanese Laid-open Patent Publication No. S51-77719

SUMMARY OF THE INVENTION

Moreover, in the manner of enabling energy of a pulse voltage and energy of an electromagnetic wave to overlap on the same transmission line, a spark plug acts as both a discharging device and an electromagnetic wave radiator (an antenna). Therefore, the structure of a plasma generator may be simplified. On the other hand, the transmission path of the electromagnetic wave from an oscillator of the electromagnetic wave to the electromagnetic wave radiator becomes complex. When the manner is applied to ignition of an internal-combustion engine, how to ensure mountability regarding the internal-combustion engine and firmness capable of enduring the environment when the internal-combustion engine is in operation is a problem to be solved.

In addition, in the manner of generating plasma by both spark discharging and electromagnetic wave radiation, although the plasma can be generated with a small amount of energy, the corresponding amount of energy is needed. Therefore, how to ensure transmission capacity and transmission efficiency of energy on the transmission path of the electromagnetic wave is a problem to be solved. The plasma generation device recorded in Patent Document 4 does not give full consideration to such problems.

The present invention is achieved with respect to the actual situation, the objectives of which are to ensure mountability, firmness, and transmission performance of energy of the electromagnetic wave in a mixer for mixing the pulse voltage and the electromagnetic wave.

The present invention has any of the following configurations for solving the problems described above.

[Configuration 1]

A mixer, mixing energy of a pulse voltage and energy of an electromagnetic wave in the same transmission line, comprising: a first input terminal, having an inner conductor and an outer conductor that form a coaxial structure, and for inputting the electromagnetic wave; a second input terminal, for inputting the pulse voltage; a hybrid output terminal, having an inner conductor and an outer conductor that form a coaxial structure, and for outputting the pulse voltage and the electromagnetic wave; a bar-shaped first electrically conductive member, having one end electrically connected to the second input terminal and the other end electrically connected to the inner conductor of the hybrid output terminal; a cylindrical second electrically conductive member, separated from and surrounding the first electrically conductive member in a spaced manner, configured to be coaxial with the first electrically conductive member, and electrically connected to the inner conductor of the first input terminal; and a cylindrical third electrically conductive member, separated from the second electrically conductive member, receiving the first electrically conductive member and the second electrically conductive member in a spaced manner, configured to be coaxial with the first electrically conductive member and the second electrically conductive member, and electrically connected to the outer conductor of the first input terminal and the outer conductor of the hybrid output terminal respectively.

[Configuration 2]

The mixer according to claim 1, wherein: the first electrically conductive member at the hybrid output terminal protrudes from an opening of the second electrically conductive member.

[Configuration 3]

The mixer according to claim 2, wherein: one end, at the second input terminal, of the first electrically conductive member is inside the second electrically conductive member.

[Configuration 4]

The mixer according to claim 3, comprising: a countercurrent stopping unit, wherein the countercurrent stopping unit electrically connects the second input terminal to the first electrically conductive member, and stops the electromagnetic wave input through the first input terminal from flowing to the second input terminal; and the countercurrent stopping unit is inserted into the inside of the second electrically conductive member, and is connected to the first electrically conductive member at the second input terminal in the inside of the second electrically conductive member.

[Configuration 5]

The mixer according to claim 4, wherein: the countercurrent stopping unit comprises a coil-shaped electrically conductive spring, which is retained by being compressed between the second input terminal and the first electrically conductive member.

[Configuration 6]

The mixer according to any one of claims 1 to 5, wherein: the inner conductor of the first input terminal is connected to the second electrically conductive member at an end portion, at the second input terminal, of the second electrically conductive member.

[Configuration 7]

The mixer according to any one of claims 1 to 6, comprising: an insulating cylinder, wherein the insulating cylinder is configured between the first electrically conductive member and the second electrically conductive member to electrically insulate the first electrically conductive member from the second electrically conductive member.

[Configuration 8]

The mixer according to any one of claims 1 to 7, comprising: a pair of electrically conductive cylinders, wherein the pair of electrically conductive cylinders are opposite to each other between an outer circumferential surface of the first electrically conductive member and an inner circumferential surface of the second electrically conductive member, and one of the pair of electrically conductive cylinders is electrically connected to the first electrically conductive member, and the other of the pair of electrically conductive cylinders is electrically connected to the second electrically conductive member.

[Configuration 9]

The mixer according to any one of claims 1 to 8, wherein: the pulse voltage and the electromagnetic wave output through the hybrid output terminal are supplied to a discharger, the discharger comprises a center conductor electrically connected to the inner conductor of the hybrid output terminal and a grounding conductor which is electrically connected to the outer conductor of the hybrid output terminal and forms a discharge gap together with the center conductor, and the center conductor and the grounding conductor form a coaxial structure; on the other hand, the hybrid output terminal is configured so that impedance of the electromagnetic wave becomes the same as that of the discharger.

[Configuration 10]

A matching device, achieving impedance matching of an electromagnetic wave from the mixer according to any one of claims 1 to 9 to a discharger electrically connected to the hybrid output terminal of the mixer, wherein: the discharger comprises a center conductor electrically connected to the inner conductor of the hybrid output terminal and a grounding conductor which is electrically connected to the outer conductor of the hybrid output terminal and forms a discharge gap together with the center conductor, and is configured so that: the center conductor and the grounding conductor form a coaxial structure, the center conductor extends along an axial direction of the hybrid output terminal, and the grounding conductor is separated from the outer conductor of the hybrid output terminal; on the other hand, the matching device comprises a cylindrical outer connecting member, and the cylindrical outer connecting member electrically connects the outer conductor of the hybrid output terminal to the grounding conductor of the discharger, and is movably disposed along an axial direction thereof.

[Configuration 11]

The matching device according to claim 10, comprising: a cylindrical insulating member, wherein the cylindrical insulating member is used to stop discharging from occurring between the inner conductor of the hybrid output terminal or the center conductor of the discharger and the outer connecting member.

[Configuration 12]

The matching device according to claim 11, wherein: the cylindrical insulating member is fixed on an inner surface of the outer connecting member.

[Configuration 13]

The matching device according to any one of claims 10 to 12, comprising: an inner connecting member, wherein the inner connecting member electrically connects the inner conductor of the hybrid output terminal to the center conductor of the discharger and retains the inner conductor and the center conductor.

[Configuration 14]

The matching device according to any one of claims 10 to 13, wherein: two end portions of the outer connecting member are bent inwards respectively, one end portion urges against the outer conductor of the hybrid output terminal, and the other end portion urges against the grounding conductor of the discharger or is electrically connected to a conductor of the grounding conductor.

[Configuration 15]

A matching device, achieving impedance matching of an electromagnetic wave from a mixer mixing energy of a pulse voltage and energy of an electromagnetic wave in the same transmission line to a discharger electrically connected to a hybrid output terminal of the mixer, wherein: the discharger comprises a center conductor electrically connected to an inner conductor of the hybrid output terminal and a grounding conductor which is electrically connected to an outer conductor of the hybrid output terminal and forms a discharge gap together with the center conductor, and is configured so that: the center conductor and the grounding conductor form a coaxial structure, the center conductor extends along an axial direction of the hybrid output terminal, and the grounding conductor is separated from the outer conductor of the hybrid output terminal; on the other hand, the matching device comprises a cylindrical outer connecting member, and the cylindrical outer connecting member electrically connects the outer conductor of the hybrid output terminal to the grounding conductor of the discharger, and is movably disposed along an axial direction thereof.

[Configuration 16]

An ignition unit, comprising: a pulse voltage generator, for generating a pulse voltage; and the mixer according to any one of claims 1 to 9, for mixing the pulse voltage output from the pulse voltage generator with an electromagnetic wave output from an electromagnetic wave source.

[Configuration 17]

An ignition unit, comprising: a pulse voltage generator, for generating a pulse voltage; the mixer according to claim 4 or 5, for mixing the pulse voltage output from the pulse voltage generator with an electromagnetic wave output from an electromagnetic wave source; and an electric resistance, connected between the second input terminal and the countercurrent stopping unit.

[Configuration 18]

A plasma generator, comprising: the ignition unit according to claim 16 or 17; and a discharger, for using the pulse voltage and the electromagnetic wave output from the ignition unit to generate plasma.

Effect of the Invention

According to the present invention, the mixer is of a coaxial structure. Therefore, mixing with the pulse voltage and transmission of the electromagnetic wave may be achieved without performing mode conversion of the electromagnetic wave, which helps to ensure the transmission efficiency of the electromagnetic wave. In addition, occurrence of surface creepage may be reduced, and leakage of energy may be suppressed, so that voltage resistance may be improved, thereby helping to ensure transferred energy and improve electrical robustness. In addition, in the coaxial structure, most members are cylindrical, thereby achieving greater rigidity than the structural weight, which helps to ensure firmness. In addition, by using the coaxial structure, the minimum width of the shape may be decreased, which helps to improve mountability.

Moreover, the transmission path of the pulse voltage is shielded by the coaxial structure. Therefore, leakage of electromagnetic noise when the pulse voltage is generated may be reduced, thereby making countermeasures for the noise be simple, and improving the mountability. In addition, loss of transferred energy incurred by noise countermeasures such as electric resistance may be suppressed, thereby ensuring transmission efficiency of energy.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Embodiments of the present invention are illustrated below in detail with reference to the accompanying drawings. Moreover, the following embodiments are essentially examples of preferred embodiments, and are not intended to limit the application or scope of usage of the present invention.

Embodiment 1

An embodiment 1 is a plasma generator 100 of the present invention. In the following, the plasma generator 100 is illustrated first, and then a mixer 300 and a matching device 400 are illustrated in sequence.

Structure of Plasma Generator

Figure 1:
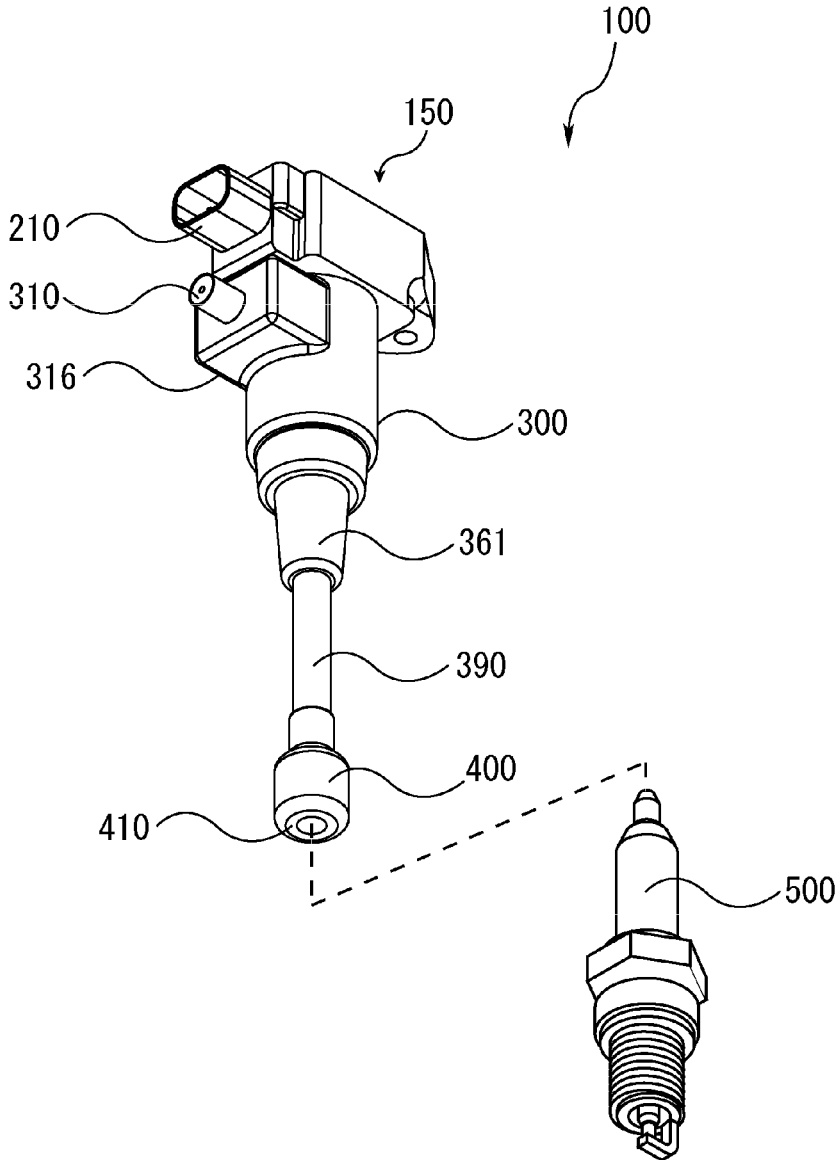
FIG. 1 is a three-dimensional view of a plasma generator of an embodiment 1.
Figure 2:
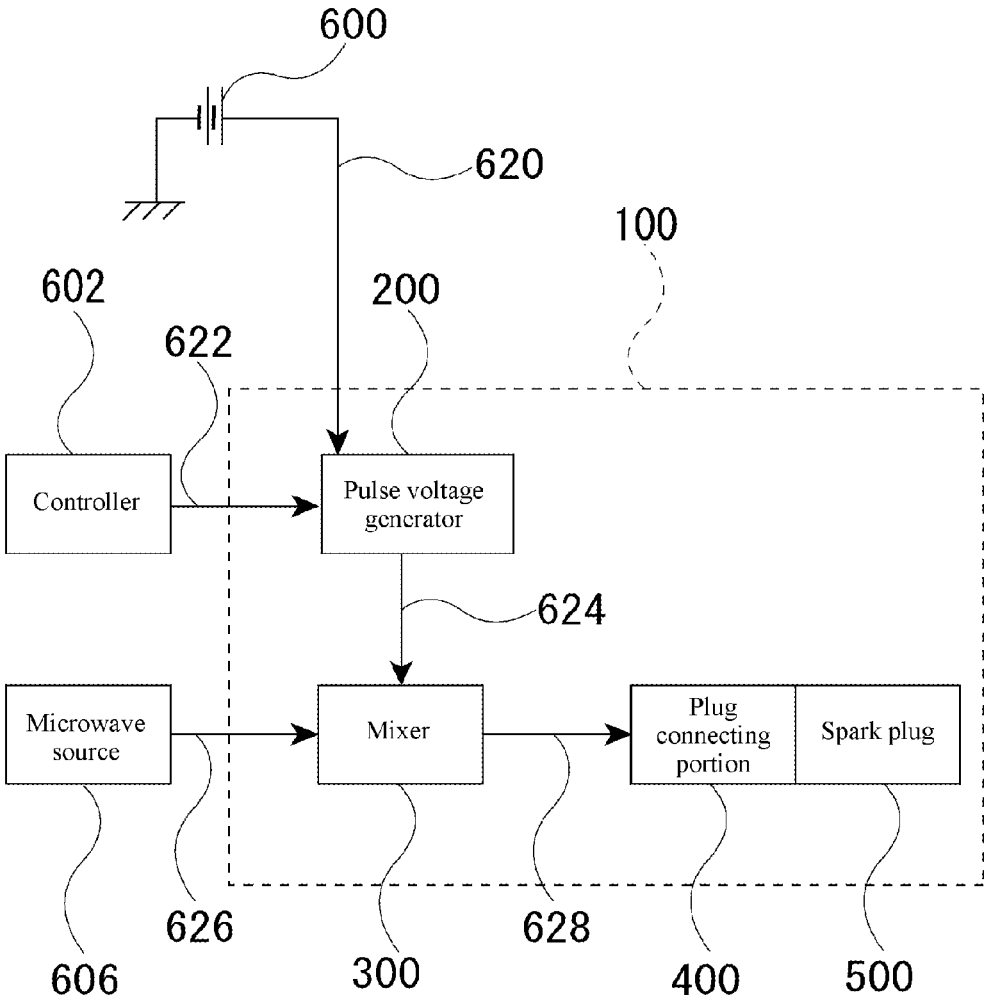
FIG. 2 is a block diagram of the plasma generator of the embodiment 1.
Figure 3:
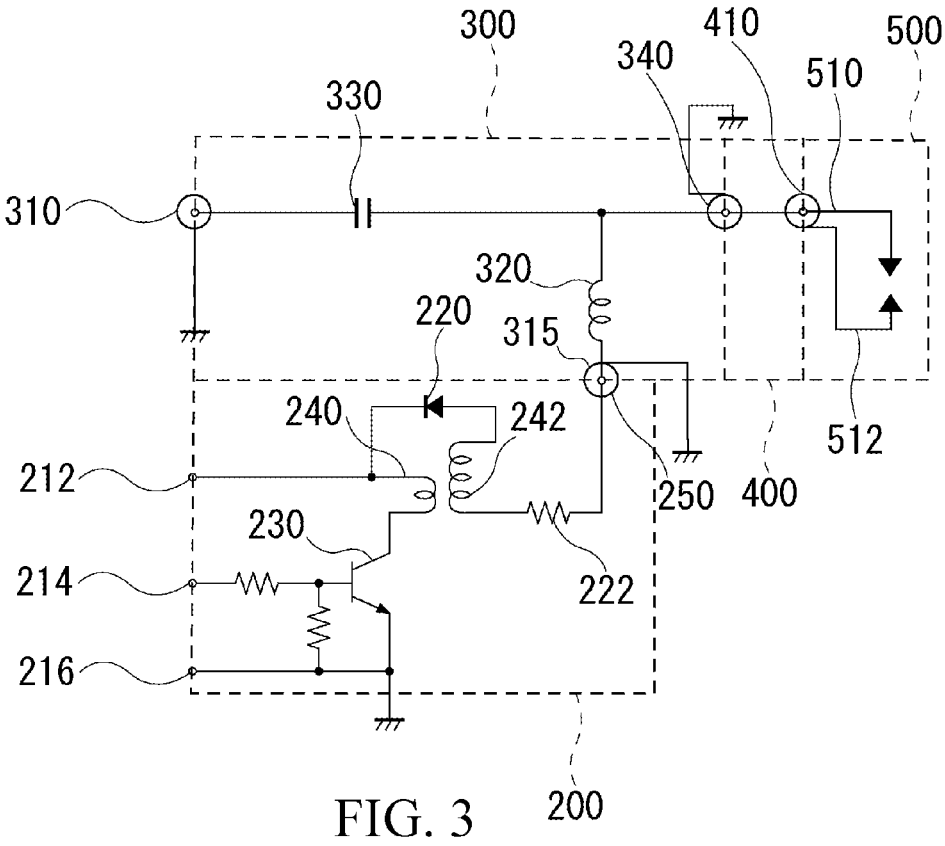
FIG. 3 is a circuit diagram of the plasma generator of the embodiment 1.

A three-dimensional view of the plasma generator 100 is shown in FIG. 1, a block diagram of the plasma generator 100 is shown in FIG. 2, and a circuit diagram of an equivalent circuit of the plasma generator 100 is shown in FIG. 3.

As shown in FIG. 1, the plasma generator 100 includes a pulse voltage generator 200, a mixer 300, a matching device 400, and a spark plug 500. The pulse voltage generator 200 is formed to be substantially boxy (substantially boxy as a rectangular cuboid). The mixer 300 is formed to be substantially cylindrical, and has one end connected to the pulse voltage generator 200. The other end of the mixer 300 is disposed with an extension portion 390 extending along an axial direction of the mixer 300. The extension portion 390 is embedded in a plug hole of an internal-combustion engine. A side surface of the cylinder of the mixer 300 is disposed with a boxy protrusion 316. The matching device 400 is formed to be cylindrical, and is disposed to surround the extension portion 390. The matching device 400 is movably disposed along an axial direction thereof, and achieves impedance matching of an electromagnetic wave from the mixer 300 to the spark plug 500. The spark plug 500 is connected to the mixer 300 through the matching device 400.

Moreover, in the plasma generator 100, the pulse voltage generator 200 and the mixer 300 are integrated. The pulse voltage generator 200 and the mixer 300 constitute an ignition unit 150. The plasma generator 100 includes the ignition unit 150, the matching device 400 and the spark plug 500. The spark plug 500 constitutes a discharger 500. In the discharger 500, a discharge gap using a pulse voltage input through the mixer 300 to discharge is formed.

A connector 210 for receiving an external input is disposed in the pulse voltage generator 200. A first input terminal 310 is disposed on the boxy protrusion 316 of the mixer 300. The first input terminal 310 is an electromagnetic wave input terminal As shown in FIG. 2, the pulse voltage generator 200 receives supply of a DC current 620 from an external DC power supply 600. The pulse voltage generator 200 operates according to a control signal 622 (called an "ignition signal" below) provided by an external controller 602 (for example, an Electronically Controlled Unit (ECU) of an automobile), and generates and outputs a high-voltage pulse voltage 624. The DC power supply 600 may be, for example, an automobile battery. A voltage of the DC current 620 may be about 12 V. The ignition signal 622 may be a positive logic pulse-like Transistor-Transistor Logic (TTL) signal. A pulse width of the ignition signal 622 may be 1 msec to 2 msec.

For the ignition signal 622, the starting of applying the signal indicates an instruction of starting power supply, and the ending of applying the signal indicates an instruction of ending the power supply and outputting the pulse voltage 624. The pulse voltage 624 is a peak voltage, for example, an impulse-like voltage signal of 6 kV to 40 kV. The specification of the pulse voltage 624 is appropriately set, so that insulation breakdown occurs when the pulse voltage 624 is applied to the spark plug 500.

The mixer 300 receives the pulse voltage 624 from the pulse voltage generator 200, and receives a microwave 626 from an external microwave source 606 (an electromagnetic wave source). In the embodiment 1, the microwave 626 has a frequency of, for example, about 2,450 MHz, and a peak input power of about 1 kW. The microwave 626 is applied in the shape of a pulse. In addition, a pulse width of the microwave 626 may be smaller than 10 msec or greater than 10 msec. The pulse of the microwave may be applied repeatedly.

The mixer 300 generates and outputs a mixed signal 628 obtained by mixing the pulse voltage 624 and the microwave 626. The mixed signal 628 is transmitted to the spark plug 500 through the matching device 400. In the spark plug 500, the applied mixed signal 628 is received, discharging takes place, and a microwave is radiated. As a result, in a discharge gap at a front end of the spark plug 500, small-scale plasma is formed by discharging, and the plasma absorbs energy of the microwave to expand.

As shown in FIG. 3, the circuit configuration of the pulse voltage generator 200 is the same as that of an ordinary device mounted on a conventional ignition coil. A DC terminal 212 for receiving an input of the DC current 620, an ignition signal terminal 214 for receiving the ignition signal 622 and a grounding terminal 216 for grounding are disposed in the pulse voltage generator 200. The DC terminal 212, the ignition signal terminal 214 and the grounding terminal 216 are disposed at the connector 210.

A switch 230, a primary side coil 240, a secondary side coil 242, and a voltage side output terminal 250 are further disposed in the pulse voltage generator 200. The switch 230 includes an npn-type transistor, in which a base is connected to the ignition signal terminal 214 and an emitter is connected to the grounding terminal 216. One end of the primary side coil 240 is connected to a collector of the switch 230, and the other end of the primary side coil 240 is connected to the DC terminal 212. The secondary side coil 242 is configured to be separated from the primary side coil 240, opposite to the secondary side coil 242, by an iron core (not shown). One end of the secondary side coil 242 is connected to the DC terminal 212 through a rectifier 220 (a diode), and the other end of the secondary side coil 242 is connected to the voltage side output terminal 250 through an electric resistance 222.

The mixer 300 includes the first input terminal 310, a second input terminal 315, a hybrid output terminal 340, a countercurrent prevention coil 320 and a condenser 330. The second input terminal 315 is connected to the voltage side output terminal 250 of the pulse voltage generator 200. The first input terminal 310 has an inner conductor 310*a* and an outer conductor 310*b* that form a coaxial structure, and is for inputting an electromagnetic wave. A pulse voltage is input into the second input terminal 315. The hybrid output terminal 340 has an inner conductor 340*a* and an outer conductor 340*b* that form a coaxial structure. The hybrid output terminal 340 outputs the pulse voltage and the electromagnetic wave. The countercurrent prevention coil 320 is connected to the second input terminal 315. The condenser 330 includes an electrical conductor rod 370 and an electrical conductor pipe 372. One end of the condenser 330 is connected to the first input terminal 310. The other end of the condenser 330 is divided into two parts, one part is connected to the countercurrent prevention coil 320, and the other part is connected to the hybrid output terminal 340.

A coil with self-inductance being 10 nH to 10 μH is selected as the countercurrent prevention coil 320. Therefore, the countercurrent prevention coil 320 on one hand stops an electromagnetic wave of a microwave band from passing, and on the other hand allows an electromagnetic wave of a band below a short-wave band or a DC to pass. The countercurrent prevention coil 320 constitutes a countercurrent stopping unit 320 for stopping a microwave input through the first input terminal 310 from flowing to the pulse voltage generator 200.

In addition, a condenser with capacitance being 1 pF to 100 pF is selected as the condenser 330. Therefore, the condenser 330 on one hand allows a microwave to pass, and on the other hand stops an electromagnetic wave of a band below a short-wave band or a DC to pass. The condenser 330 constitutes a unit for stopping a voltage pulse input through the second input terminal 315 from flowing to the first input terminal 310.

In the equivalent circuit, one end of the matching device 400 is connected to the hybrid output terminal 340 of the mixer 300, and the other end of the matching device 400 is connected to the spark plug 500. The other end of the matching device 400 is disposed with a plug connecting end 410 for being connected to the spark plug 500.

The circuit configuration of the spark plug 500 is the same as the circuit configuration of an ordinary spark plug. The spark plug 500 is a discharger, which includes a center conductor 510 electrically connected to the inner conductor 340*a* of the hybrid output terminal 340 and a grounding conductor 512 electrically connected to the outer conductor 340*b* of the hybrid output terminal 340. In the spark plug 500, the center conductor 510 and the grounding conductor 512 form a coaxial structure.

In the spark plug 500, the center conductor 510 and the grounding conductor 512 constitute a pair of opposite electrodes. The discharge gap is formed between the center conductor 510 and the grounding conductor 512. Moreover, in the embodiment 1, no electric resistance is disposed in the center conductor 510 of the spark plug 500, which is an ideal structure for ensuring the transmission efficiency of the microwave.

According to the structure, if the ignition signal 622 is applied to the base of the switch 230, the current flows to the primary side coil 240, and a magnetic field near the iron core changes, so that electric charges are accumulated. In the case, if the application of the ignition signal 622 to the base of the switch 230 is stopped, the power supply to the primary side coil 240 ends, so that the electric charges flow to the secondary side coil 242. As a result, in the pulse voltage generator 200, a great potential difference is incurred between the grounding side and the side of the voltage side output terminal 250. Then, the high-voltage pulse voltage 624 is applied to the voltage side output terminal 250.

The pulse voltage 624 is transferred to the hybrid output terminal 340 through the countercurrent prevention coil 320. The pulse voltage 624 does not flow to the side of the first input terminal 310 due to the existence of the condenser 330. On the other hand, the microwave 626 input through the first input terminal 310 is transferred to the hybrid output terminal 340 through the condenser 330. The microwave 626 does not flow to the side of the pulse voltage generator 200 due to the existence of the countercurrent prevention coil 320.

In the mixer 300, the pulse voltage 624 and the microwave 626 are output from the hybrid output terminal 340 after being mixed. The pulse voltage 624 and the microwave 626 are supplied to the spark plug 500 through the matching device 400. As a result, in the spark plug 500, the pulse voltage 624 and the microwave 626 are applied in the discharge gap, thereby generating plasma.

Structure of Mixer

Figure 4:
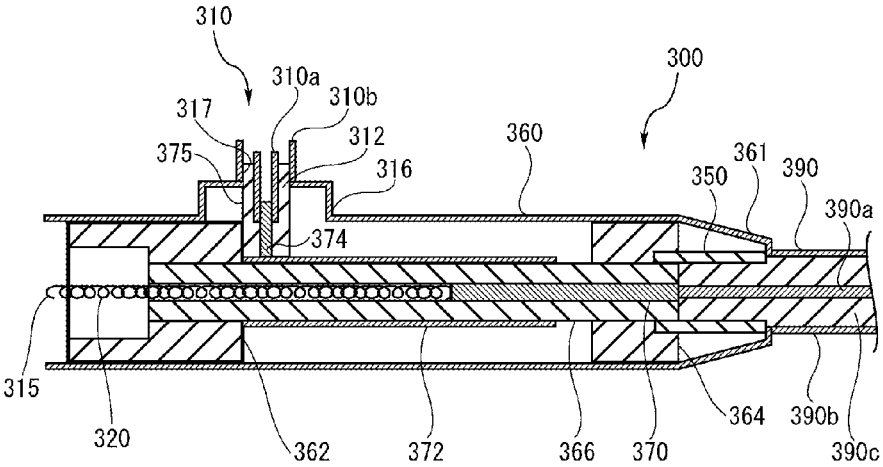
FIG. 4 is a sectional view of a mixer of the embodiment 1.

As shown in FIG. 4, the mixer 300 includes the electrical conductor rod 370, the electrical conductor pipe 372, a first dielectric ring 362, a second dielectric ring 364, a dielectric pipe 366 and a housing 360.

The housing 360 substantially forms the shape of the mixer 300. The material of the housing 360 is an electrical conductor, such as metal. The housing 360 is formed to be in the shape of a cylinder having two open ends. A side surface of the housing 360 is disposed with the boxy protrusion 316. An opening 317 for exposing the first input terminal 310 is formed on the boxy protrusion 316. The housing 360 urges against the outer conductor 310*b* of the first input terminal 310 at the whole periphery of the opening 317. The housing 360 constitutes a third electrically conductive member 360. The third electrically conductive member 360 is separated from the electrical conductor pipe 372, receives the electrical conductor rod 370 and the electrical conductor pipe 372 in a spaced manner, is configured to be coaxial with the electrical conductor rod 370 and the electrical conductor pipe 372, and is electrically connected to the outer conductor 310*b* of the first input terminal 310 and the outer conductor 340*b* of the hybrid output terminal 340 respectively.

The housing 360 has a tapered portion 361 formed at one end portion, which has a gradually decreasing radius towards the end portion, thereby forming a taper. A front end connected to the tapered portion 361 becomes the extension portion 390 of the hybrid output terminal 340. The extension portion 390 includes a coaxial cable. An inner conductor 390*a* of the extension portion 390 urges against the electrical conductor rod 370. An outer conductor 390*b* of the extension portion 390 urges against one end of the tapered portion 361 of the housing 360 along the whole periphery. A dielectric layer 390*c* of the extension portion 390 urges against the dielectric pipe 366 in the inside of a connecting cylinder 350 including an insulator. The connecting cylinder 350 has one end embedded in a notch of the second dielectric ring 364, so as to be fixed. The connecting cylinder 350 retains the dielectric layer 390*c* of the extension portion 390.

On the other hand, the other end portion of the housing 360 is mounted at the pulse voltage generator 200. The other end portion of the housing 360 is disposed with the second input terminal 315 connected to the voltage side output terminal 250 of the pulse voltage generator 200. In the embodiment 1, one end, opposite to the electrical conductor rod 370, of the countercurrent prevention coil 320 becomes the second input terminal 315.

An outer surface shape of the cylindrical first dielectric ring 362 remains the same along the whole axial direction. The first dielectric ring 362 is disposed at the second input terminal 315 of the housing 360, and is embedded inside the housing 360. The outer surface of the first dielectric ring 362 urges against an inner surface of the housing 360 along the whole periphery.

An inner surface of the first dielectric ring 362 forms a step. The first dielectric ring 362 has two inner surface shapes divided by the step. An inner surface shape, at the second input terminal 315, of the first dielectric ring 362 is set to be capable of being engaged with the pulse voltage generator 200. An inner surface shape, at the hybrid output terminal 340, of the first dielectric ring 362 is set to be capable of being engaged with the dielectric pipe 366.

An inner surface shape and an outer surface shape of the cylindrical second dielectric ring 364 both remain the same along the whole axial direction. The second dielectric ring 364 is disposed at the hybrid output terminal 340 of the housing 360, and is embedded inside the housing 360. The outer surface of the second dielectric ring 364 urges against the inner surface of the housing 360 along the whole periphery.

The inner surface shape of the second dielectric ring 364 is set to be capable of being engaged with the dielectric pipe 366. That is to say, the inner surface of the second dielectric ring 364 is the same as the inner surface, at the hybrid output terminal 340, of the first dielectric ring 362 in size and shape. An axis of the inner surface and the outer surface of the second dielectric ring 364 is substantially the same as an axis of the inner surface and the outer surface of the first dielectric ring 362.

The cylindrical dielectric pipe 366 extends between the first dielectric ring 362 and the second dielectric ring 364. The dielectric pipe 366 has one end portion embedded inside the first dielectric ring 362, and has the other end portion embedded inside the second dielectric ring 364. The thickness of the dielectric pipe 366 is set so that even if the pulse voltage 624 or the microwave 626 is applied to the inner surface and the outer surface, no insulation breakdown occurs. The dielectric pipe 366 constitutes an insulating cylinder 366. The insulating cylinder 366 is configured between the electrical conductor rod 370 and the electrical conductor pipe 372 to electrically insulate the electrical conductor rod 370 from the electrical conductor pipe 372.

The material of the first dielectric ring 362, the second dielectric ring 364 and the dielectric pipe 366 may not only be so-called fluorine resin or polyethylene resin, but may also be other dielectrics (for example, ceramics). If the plasma generator 100 is applied to ignition of an internal-combustion engine, ideally a material having high heat resistance is selected. In addition, ideally a material having high insulation endurance is applied to the dielectric pipe 366.

The electrical conductor rod 370 is formed to be cylindrical, and is embedded inside the dielectric pipe 366. The electrical conductor rod 370 is embedded at the hybrid output terminal 340 of the dielectric pipe 366. The electrical conductor rod 370 has one end electrically connected to the second input terminal 315, and the other end electrically connected to a first electrically conductive member 370 of the inner conductor of the hybrid output terminal 340.

The electrical conductor rod 370 at the hybrid output terminal 340 protrudes from an opening of the electrical conductor pipe 372. One end, at the second input terminal 315, of the electrical conductor rod 370 is inside the electrical conductor pipe 372.

The countercurrent prevention coil 320 including a coil-shaped electrically conductive spring is inserted into the dielectric pipe 366 at the second input terminal 315. The countercurrent prevention coil 320 shown in FIG. 4 forms a compression spring, a free length of which is greater than the distance between the voltage side output terminal 250 and the electrical conductor rod 370 when the pulse voltage generator 200 is engaged with the mixer 300. Therefore, if the pulse voltage generator 200 is engaged with the mixer 300, the end portions of the countercurrent prevention coil 320 urge against the voltage side output terminal 250 and the electrical conductor rod 370 respectively. The countercurrent prevention coil 320 remains compressed between the second input terminal and the electrical conductor rod 370. The countercurrent prevention coil 320 electrically connects the voltage side output terminal 250 to the electrical conductor rod 370. The countercurrent prevention coil 320 is connected to the electrical conductor rod 370 at the second input terminal 315 in the inside of the electrical conductor pipe 372.

The electrical conductor pipe 372 is formed to be cylindrical, and is disposed on the outer surface of the dielectric pipe 366. The electrical conductor pipe 372 covers a central outer surface of the dielectric pipe 366 along the whole periphery. The inner surface of the electrical conductor pipe 372 urges against the outer surface of the dielectric pipe 366 along the whole axial direction. The electrical conductor pipe 372 constitutes a second electrically conductive member 372. The second electrically conductive member 372 is separated from and surrounds the electrical conductor rod 370 in a spaced manner, is configured to be coaxial with the electrical conductor rod 370, and is electrically connected to the inner conductor 310*a* of the first input terminal 310.

The inner surface, at the hybrid output terminal 340, of the electrical conductor pipe 372 is opposite to the electrical conductor rod 370 with the dielectric pipe 366 being a separator therebetween. The opposite parts become the condenser 330 shown in FIG. 3. The area of the opposite parts constituting the condenser 330 is set so that the capacitance of the condenser 330 is a desired value. The diameter of the electrical conductor rod 370 and the length of the opposite parts in the axial direction are set, so as to not only achieve matching of impedance of the microwave but also enable the capacitance of the condenser 330 to be a desired value. The electrical conductor rod 370 protrudes from the opening, at the hybrid output terminal 340, of the electrical conductor pipe 372. That is to say, a part of the electrical conductor rod 370 and a part of the electrical conductor pipe 372 overlap in the axial directions thereof.

Moreover, in the embodiment 1, the electrical conductor pipe 372 extends to a position to surround the countercurrent prevention coil 320, but alternatively may not extend to the position to surround the countercurrent prevention coil 320. The length of the electrical conductor pipe 372 is set to increase the transmission efficiency of the microwave.

The outer surface of the end portion, at the second input terminal 315, of the electrical conductor pipe 372 is connected to a protrusion 374 protruding from the outer surface along a longitudinal direction. The inner conductor 310*a* of the first input terminal 310 is mounted on the protrusion 374. The protrusion 374 and the inner conductor 310*a* of the first input terminal 310 are embedded inside an input side cylindrical member 312 including an insulator. The inner conductor 310*a* of the first input terminal 310 is configured so that an inner conductor of the coaxial cable can be inserted.

In the embodiment 1, the inner conductor 310*a* of the first input terminal 310 is connected to the electrical conductor pipe 372 at the end portion, at the second input terminal 315, of the electrical conductor pipe 372. If the electrical conductor pipe 372 at the second input terminal 315 can receive power supply of the microwave, the transmission efficiency of the microwave is increased. In the housing 360, the position of the boxy protrusion 316 is determined according to the position of the protrusion 374 extending from the outer surface of the electrical conductor pipe 372.

The hybrid output terminal 340 includes a front end portion of the extension portion 390. The inner conductor 340*a* of the hybrid output terminal 340 is electrically connected to the electrical conductor rod 370. The outer conductor 340*b* of the hybrid output terminal 340 is electrically connected to the housing 360. The extension portion 390 and the housing 360 may be detachable through a connector, or may be fixed.

Structure of Matching Device

Figure 5:
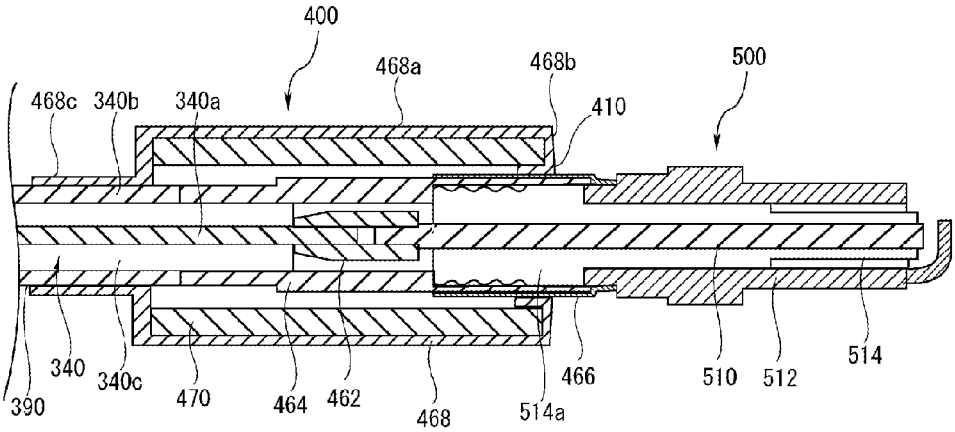
FIG. 5 is a sectional view of a matching device of the embodiment 1.

As shown in FIG. 5, the matching device 400 includes an inner connecting member 462, an insulator insertion member 464, an outer fixing member 466, an outer connecting member 468 and a dielectric member 470.

The inner connecting member 462 includes an electrical conductor. The inner connecting member 462 is clamped at an input end of the center conductor 510 of the spark plug 500. Specifically, an inner surface of the inner connecting member 462 is formed with a thread groove. The thread groove of the inner connecting member 462 is screwed together with a thread groove of an outer surface of the center conductor 510 of the spark plug 500. The inner conductor 340*a* of the hybrid output terminal 340 is embedded in the inner connecting member 462. The inner connecting member 462 electrically connects the inner conductor 340*a* of the hybrid output terminal 340 to the center conductor 510 of the spark plug 500, and retains the inner conductor 340*a* and the center conductor 510.

The insulator insertion member 464 is a substantially cylindrical insulating member. The insulator insertion member 464 receives the inner connecting member 462. A dielectric layer 340*c* of the hybrid output terminal 340 is inserted into the insulator insertion member 464 at the mixer 300. An ideal peripheral shape of the insulator insertion member 464 at the hybrid output terminal 340, when viewed in the axial direction thereof, does not exceed the peripheral shape of the outer conductor 340*b* of the hybrid output terminal 340. On the other hand, the insulator insertion member 464 at the spark plug 500 covers an exposed part 514*a* of an input side of an insulator 514 of the spark plug 500, and is embedded outside the exposed part 514*a*. The insulator insertion member 464 protrudes from one end, at the discharge gap, of the exposed part 514*a*, and the protruding part urges against the end portion of the grounding conductor 512 of the spark plug 500 along the whole periphery.

The outer fixing member 466 includes a strip-shaped or cylindrical electrical conductor. The outer fixing member 466 surrounds an outer circumferential surface, at the spark plug 500, of the insulator insertion member 464 along the whole periphery, and is joined to the insulator insertion member 464. The outer fixing member 466 protrudes from one end, at the discharge gap, of the insulator insertion member 464, and the protruding part is bent inwards to urge against the grounding conductor 512 of the spark plug 500. The protruding part urges against the input side of the grounding conductor 512 of the spark plug 500 along the whole periphery. The outer fixing member 466 is insulated from the inner conductor 340*a* of the hybrid output terminal 340 and the inner connecting member 462 by using the insulator insertion member 464. Moreover, the outer fixing member 466 is not shown in FIG. 1.

The outer connecting member 468 includes a cylindrical electrical conductor. The outer connecting member 468, within a range from the hybrid output terminal 340 in the axial direction to a base end side of the spark plug 500, surrounds the hybrid output terminal 340, the inner connecting member 462, the insulator insertion member 464 and the outer fixing member 466.

In FIG. 5, the outer connecting member 468 is formed to have two concentrated end portions. The two end portions of the outer connecting member 468 are bent inwards. The end portion, at the mixer 300, of the outer connecting member 468 urges against the outer conductor 340*b* of the hybrid output terminal 340 along the whole periphery. The end portion, at the spark plug 500, of the outer connecting member 468 urges against the outer fixing member 466 along the whole periphery. The outer connecting member 468 has one end portion urging against the outer conductor 340*b* of the hybrid output terminal 340, and the other end portion urging against the outer fixing member 466 electrically connected to the grounding conductor 512 of the spark plug 500. Moreover, the outer connecting member 468 may be configured so that the end portion at the spark plug 500 urges against the conductor 512 along the whole periphery.

In the outer connecting member 468, an inner circumferential surface of a body portion 468*a* between the two end portions is separated from the outer circumferential surface of the insulator insertion member 464 along the whole periphery. An end portion 468*b*, at the spark plug 500, of the outer connecting member 468 is formed by being rolled inwards. An inwardly bent frontmost end of an end portion 468*c*, at the mixer 300, of the outer connecting member 468 is along the outer surface of the outer conductor 340*b* of the hybrid output terminal 340. Moreover, the two end portions 468*b*, 468*c* of the outer connecting member 468 may appropriately adopt various shapes, such as the shape with a gradually decreasing diameter, in addition to the shapes shown in FIG. 5.

The outer connecting member 468 is movably disposed along the axial direction thereof. The outer connecting member 468 electrically connects the outer conductor 340*b* of the hybrid output terminal 340 to the grounding conductor 512 of the spark plug 500. Moreover, the spark plug 500 is configured so that the grounding conductor 512 is separated from the outer conductor 340*b* of the hybrid output terminal 340. The center conductor 510 of the spark plug 500 extends along the axial direction of the hybrid output terminal 340.

The dielectric member 470 is formed to be cylindrical, and is configured inside the outer connecting member 468. The dielectric member 470 is joined to the inner surface of the body portion 468*a* of the outer connecting member 468. The dielectric member 470 constitutes a cylindrical insulating member 470. The cylindrical insulating member 470 is used to stop discharging from occurring between the inner conductor 340*a* of the hybrid output terminal 340 or the center conductor 510 of the spark plug 500 and the outer connecting member 468.

In the embodiment 1, through the inner connecting member 462, the insulator insertion member 464, the outer fixing member 466 and the outer connecting member 468, the mixed signal 628 input by the mixer 300 may be applied to the spark plug 500 without incurring any leakage.

In addition, in the matching device 400, according to the positions of the outer connecting member 468 and the dielectric member 470 in the axial direction, frequency characteristics of the impedance may change. In the embodiment 1, the outer connecting member 468 is slideably mounted relative to the outer conductor 340*b* of the hybrid output terminal 340 and the outer fixing member 466. Therefore, the frequency characteristics of the impedance may be adjusted anytime. Moreover, after the position of the outer connecting member 468 in the axial direction is adjusted, the outer connecting member 468 may be fixed. In addition, with the optimal position of the outer connecting member 468 being known, the outer connecting member 468 may be integrated relative to the outer conductor 340*b* of the hybrid output terminal 340 and the outer fixing member 466 in advance.

By appropriately setting configurations of the inner connecting member 462, the insulator insertion member 464, the outer fixing member 466 and the outer connecting member 468, transmission efficiency of a microwave component in a mixed signal 280 may be adjusted. Through the adjustment, the transmission efficiency of the microwave may be ensured easily.

Effects of Embodiment 1

In the embodiment 1, any part, for transmitting the microwave, in the plasma generator 100 is of a coaxial structure. Therefore, mixing with the pulse voltage and transmission of the microwave may be achieved without performing mode conversion of the microwave, which helps to ensure the transmission efficiency of the microwave. In addition, as any part for transmitting the microwave is formed to be of the coaxial structure, the length of an edge of each electrically conductive member may be decreased. Therefore, occurrence of surface creepage that easily occurs at the edge of the electrically conductive member may be reduced, and leakage of energy may be suppressed. Therefore, voltage resistance may be improved, thereby helping to ensure transferred energy and improve electrical robustness.

In addition, in the coaxial structure, most members are cylindrical, thereby achieving greater rigidity than the structural weight, which helps to ensure firmness. In addition, due to the coaxial structure, the minimum width of the shape may be decreased, which helps to improve mountability. Moreover, due to the coaxial structure, the transmission path of the pulse voltage is shielded. Therefore, leakage of electromagnetic noise when the pulse voltage is generated may be reduced, thereby making countermeasures for the noise be simple, and improving the mountability.

In addition, loss of transferred energy incurred by noise countermeasures such as electric resistance may be suppressed, thereby ensuring transmission efficiency of energy. In addition, in the plasma generator 100, each functional portion is configured to be detachable, thereby facilitating modularization. Therefore, the design, manufacturing, inspection, and part replacement are simplified, thereby helping to ensure the mountability.

In addition, the matching device 400 has a structure capable of being connected to an ordinary spark plug easily, so that the transmission efficiency may be adjusted easily. Therefore, the energy may be transferred to the spark plug with high efficiency. Therefore, the generation of plasma by using the spark plug 500 is made easy, thereby making the plasma particularly applicable to ignition of the internal-combustion engine.

Moreover, if the housing of the pulse voltage generator 200 is an electrical conductor, such as metal, the microwave shielding performance may be improved as long as the end portion, at the pulse voltage generator 200, of the housing 360 of the mixer 300 contacts with the housing of the pulse voltage generator 200 along the whole periphery.

Variation 1 of Embodiment 1

Figure 6:
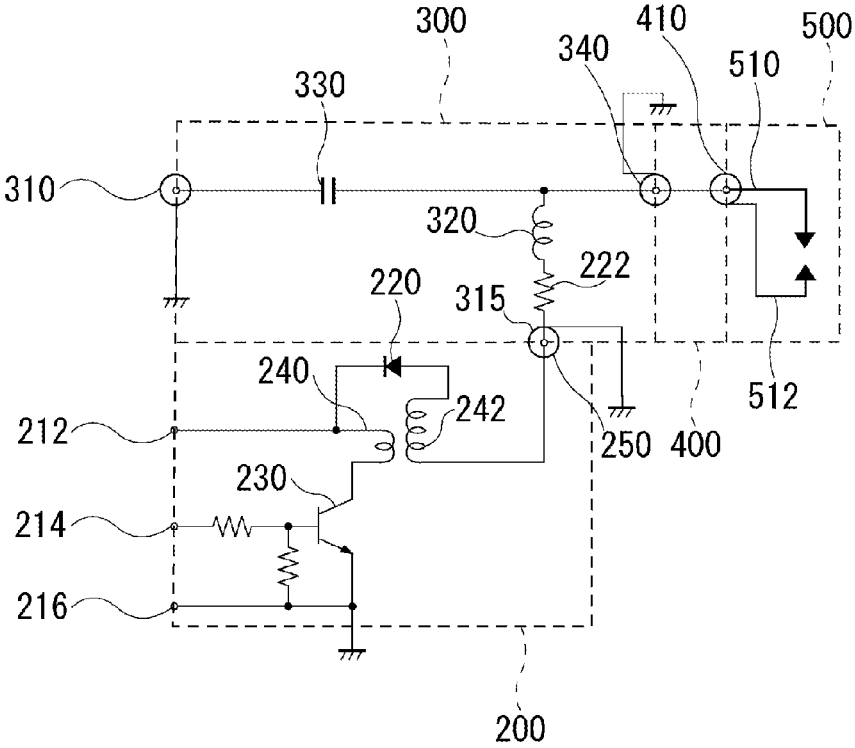
FIG. 6 is a circuit diagram of a plasma generator of a variation 1 of the embodiment 1.

A variation 1 of the embodiment 1 is illustrated. In the variation 1, as shown in FIG. 6, in the embodiment 1, the electric resistance 222 disposed on the pulse voltage generator 200 is disposed in the mixer 300. The electric resistance 222 is connected between the second input terminal 315 and the countercurrent prevention coil 320. Therefore, an ordinary ignition coil may be directly used for the pulse voltage generator 200, and an electric resistance value of the electric resistance 222 may be appropriately set in the design of the mixer 300.

Variation 2 of Embodiment 1

Figure 7:
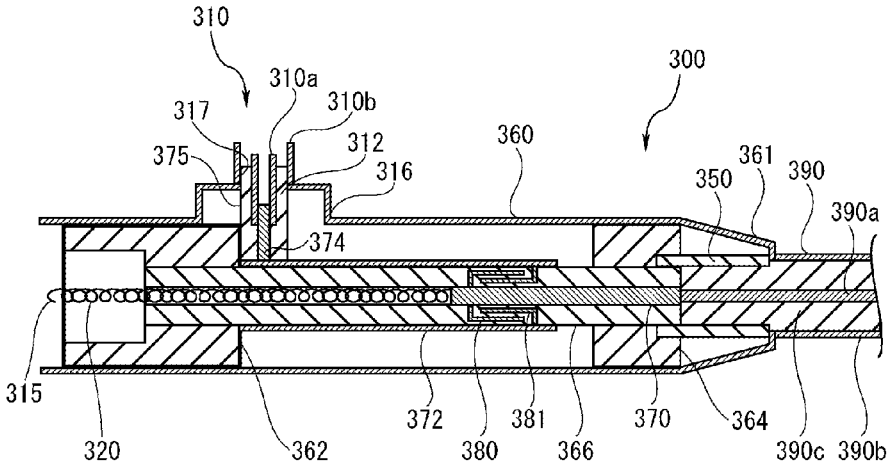
FIG. 7 is a sectional view of a mixer of a variation 2 of the embodiment 1.

A variation 2 of the embodiment 1 is illustrated. In the variation 2, as shown in FIG. 7, a pair of electrically conductive cylinders 380, 381 opposite to each other are disposed between the outer circumferential surface of the electrical conductor rod 370 and the inner circumferential surface of the electrical conductor pipe 372. One end of the first electrically conductive cylinder 380 is bent towards the electrical conductor rod 370, and is joined to the outer circumferential surface of the electrical conductor rod 370. One end of the second electrically conductive cylinder 381 is bent towards the electrical conductor pipe 372, and is joined to the electrical conductor pipe 372. The pair of electrically conductive cylinders 380, 381 are buried in the dielectric pipe 366. Therefore, the pair of electrically conductive cylinders 380, 381 bear part of capacitance of the condenser 330. Therefore, the length of opposite parts of the electrical conductor rod 370 and the electrical conductor pipe 372 may be decreased, thereby decreasing the length of the mixer 340 in the axial direction.

Variation 3 of Embodiment 1

Figure 8:
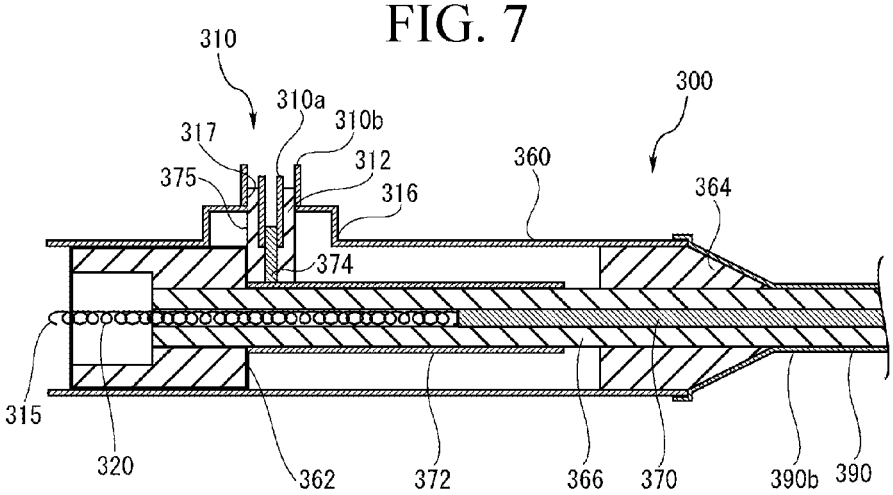
FIG. 8 is a sectional view of a mixer of a variation 3 of the embodiment 1.

A variation 3 of the embodiment 1 is illustrated. In the variation 3, as shown in FIG. 8, the electrical conductor rod 370, the dielectric pipe 366 and the outer conductor 390*a* jointly constitute the extension portion 390. Therefore, the change in impedance at the boundary between the housing 360 and the extension portion 390 is reduced.

Embodiment 2

Figure 9:
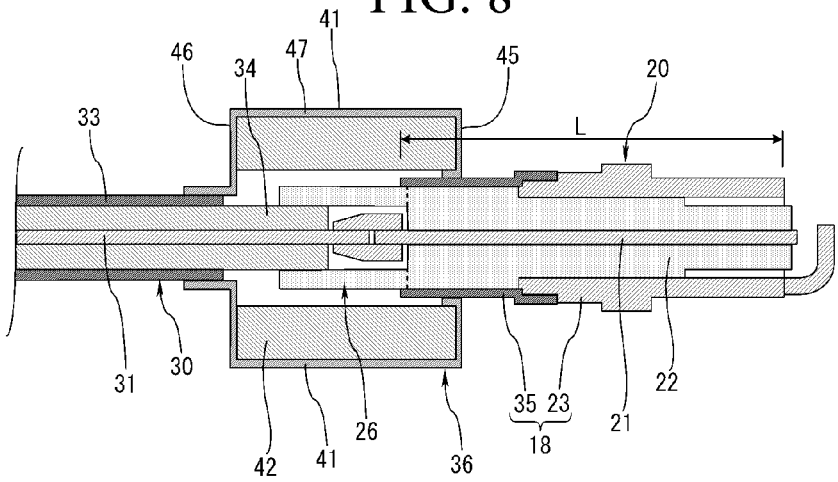
FIG. 9 is a sectional view of a matching device of an embodiment 2.

An embodiment 2 is illustrated. In the embodiment 2, as shown in FIG. 9, a cylindrical protruding portion 26 is disposed at the base end side of an insulator 22 of a spark plug 20, so as to replace the disposed insulator insertion member 464.

The cylindrical protruding portion 26 and the insulator 22 of the spark plug 20 are integrally formed. Therefore, for the cylindrical protruding portion 26 at the spark plug 20, discharging between a conductor inside the cylindrical protruding portion 26 and a conductor outside the cylindrical protruding portion 26 is prevented. A dielectric layer 34 of a hybrid output terminal 30 is embedded inside the cylindrical protruding portion 26. An inner circumferential surface of the cylindrical protruding portion 26 urges against an outer circumferential surface of the dielectric layer 34 of the hybrid output terminal 30 along the whole periphery. The dielectric layer 34 is disposed between a center conductor 31 and an outer conductor 33.

An outer fixing member 35 is a thin cylindrical conductor. One end of the outer fixing member 35 contacts with a grounding conductor 23. The outer fixing member 35 and the grounding conductor 23 jointly constitute a plug side outer conductor 18.

An outer connector 36 includes an outer connecting member 41 electrically connecting the outer fixing member 35 to the outer conductor 33 of the hybrid output terminal 30, and a dielectric member 42 mounted on an inner surface of the outer connecting member 41.

The outer connecting member 41 includes a substantially cylindrical conductor. The outer connecting member 41 is disposed to surround the cylindrical protruding portion 26. A plug side end portion 45 and a mixer side end portion 46 of the outer connecting member 41 are bent inwards. An inner circumferential surface of a body portion 47 between the plug side end portion 45 and the mixer side end portion 46 is separated from an outer circumferential surface of the cylindrical protruding portion 26 along the whole periphery.

The dielectric member 42 includes a substantially cylindrical insulator. The dielectric member 42 covers the body portion 47 of the outer connecting member 41 in the axial direction, and is fixed to an inner circumferential surface of the body portion 47. The dielectric member 42 has one end urging against an inner surface of the plug side end portion 45, and the other end urging against an inner surface of the mixer side end portion 46.

Moreover, impedance of a connecting part of the outer connecting member 41 and the plug side outer conductor 18 changes greatly with respect to the microwave. Therefore, one end, at the mixer 300, of the plug side outer conductor 18 becomes a middle part of a synthesized wave of an incident wave and a reflected wave of the microwave. The end, at the mixer 300, of the plug side outer conductor 18 is at a high potential. On the other hand, in the outer connecting member 41, a low potential area may appear in the body portion 47. Without the dielectric member 42, discharging may occur between the low potential area of the body portion 47 and the base end side of the plug side outer conductor 18. Therefore, in the embodiment 2, the dielectric member 42 is disposed inside the body portion 47 of the outer connecting member 41. Therefore, discharging between the body portion 47 and the plug side outer conductor 18 may be prevented.

In addition, the inner circumferential surface of the cylindrical protruding portion 26 urges against the outer circumferential surface of the dielectric layer 34 of the hybrid output terminal 30 along the whole periphery. For the cylindrical protruding portion 26 at the mixer 300, the length of the dielectric layer 34 for engagement is ensured so as to electrically insulate the conductor inside the cylindrical protruding portion 26 from the conductor outside the cylindrical protruding portion 26.

In addition, the length (L) of the plug side outer conductor 18 in an axial direction of a center conductor 21 is set to satisfy the following equation 1 with respect to the wavelength (λ) of the microwave circulating in the spark plug 20 (the wavelength of the microwave inside the insulator 22 of the spark plug 20). In the following equation 1, N represents a natural number.

$$L=(\lambda/2)\times N. \qquad \text{Equation 1}$$

If the length (L) of the plug side outer conductor 18 is set according to the equation 1, the synthesized wave of the incident wave and the reflected wave of the microwave may become a standing wave inside the plug side outer conductor 18. The two ends of the plug side outer conductor 18 are always the middle part of the standing wave. Therefore, during oscillation of the microwave, a great potential difference is maintained at a front end of the center conductor 21, thereby effectively supplying energy of the microwave to the plasma.

Variation 1 of Embodiment 2

Figure 10:
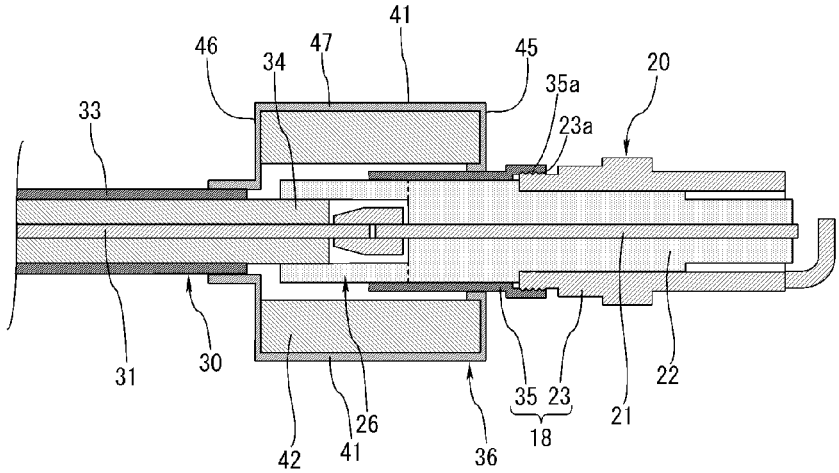
FIG. 10 is a sectional view of a matching device of a variation 1 of the embodiment 2.

A variation 1 of the embodiment 2 is illustrated. In the variation 1, as shown in FIG. 10, a thread groove 35*a* is formed on an inner circumferential surface at one end of the outer fixing member 35. The outer fixing member 35 is mounted on the spark plug 20 by screwing the thread groove 35*a* together with a thread groove 23*a* formed on an outer circumferential surface of a base end side of the grounding conductor 23. According to the variation 1, the length (L) of the plug side outer conductor 18 in the axial direction of the center conductor 21 may be adjusted easily to satisfy the equation 1.

Variation 2 of Embodiment 2

Figure 11:
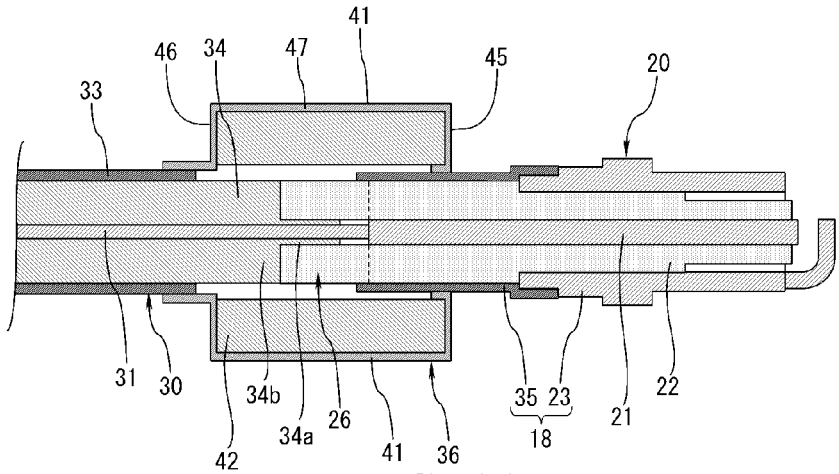
FIG. 11 is a sectional view of a matching device of a variation 2 of the embodiment 2.

A variation 2 of the embodiment 2 is illustrated. In the variation 2, as shown in FIG. 11, the dielectric layer 34 of the hybrid output terminal 30 includes a small-diameter portion 34*a* at the front end and a large-diameter portion 34*b* connected to the small-diameter portion 34*a*. The small-diameter portion 34*a* is embedded inside the cylindrical protruding portion 26. In the variation 2, for the cylindrical protruding portion 26 at the mixer 300, discharging between the conductor inside the cylindrical protruding portion 26 and the conductor outside the cylindrical protruding portion 26 may surely be prevented.

Variation 3 of Embodiment 2

Figure 12:
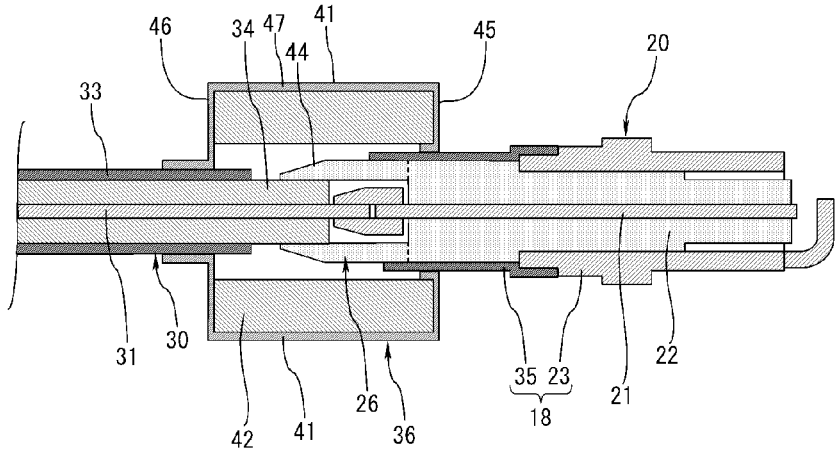
FIG. 12 is a sectional view of a matching device of a variation 3 of the embodiment 2.

A variation 3 of the embodiment 2 is illustrated. In the variation 3, as shown in FIG. 12, a tapered portion 44 is formed at an end portion, at the mixer 300, of the cylindrical protruding portion 26. The tapered portion 44 has an increasing outer diameter towards the base end of the cylindrical protruding portion 26. Therefore, the change in the impedance of the matching device 400 may be alleviated.

Other Embodiments

The embodiment may also be implemented in the following manner.

In the embodiment, the electrical conductor rod 370 may be a cylindrical rod body. In this case, the inner conductor 390*a* of the extension portion 390 may be inserted into the inside the electrical conductor rod 370. Therefore, the extension portion 390 may be easily connected to one end of the electrical conductor rod 370.

In addition, in the embodiment, the hybrid output terminal 340 may be configured so that the impedance of the microwave becomes the same as that of the spark plug 500. As shown in FIG. 5, when the thickness of the insulator 514 in the spark plug 500 changes in steps, the hybrid output terminal 340 is configured so that the impedance of the microwave becomes the same as that at the input side (the exposed part 514*a*) of the spark plug 500.

In addition, in the embodiment, the extension portion 390 may not be connected to the tapered portion 361 of the housing 360, and instead the hybrid output terminal 340 is disposed at one end of the tapered portion 361 of the housing 360.

In addition, in the embodiment, the mixer 300 and the matching device 400 may be integrated respectively through mold resin. In addition, the whole plasma generator 100 may be integrated through mold resin. In addition, as the spark plug 500 exposed to plasma experiences too much loss, parts except for the spark plug 500 in the plasma generator 100 may be integrated, so as to mount or detach the spark plug 500 relative to the integrated parts.

In addition, in the embodiment, an ordinary ignition coil is used as an example of the pulse voltage generator 200, but the present invention is not limited to the device. Various devices may be used as the pulse voltage generator 200 as long as the devices are capable of applying a pulse voltage.

In addition, in the embodiment, the spark plug 500 is used as an example of the discharger, but the present invention is not limited to the discharger. Other dischargers having a discharge gap may be used to replace the spark plug 500. However, the member of the matching device 400 must be in the shape corresponding to the applied discharger.

In addition, in the embodiment, the electromagnetic wave is used as an example of the microwave, but the present invention is not limited to the electromagnetic wave of the frequency band. It is only required to appropriately select the frequency band of the electromagnetic wave. However, the size of each member has to be set according to the frequency of the selected electromagnetic wave.

Figure 13:
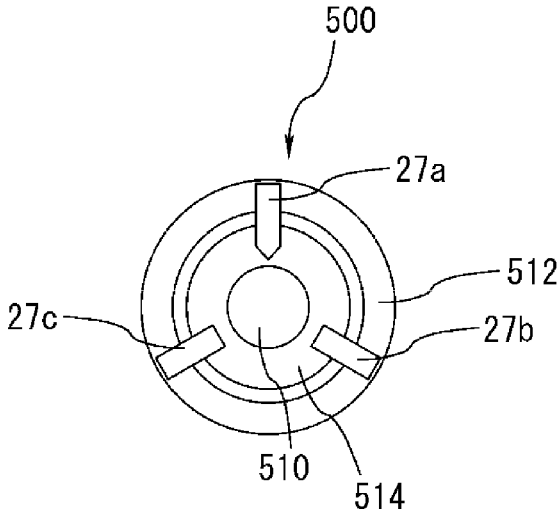
FIG. 13 is a front view of a front end surface of a spark plug of other embodiments.

In the embodiment, as shown in FIG. 13, the spark plug 500 is a device having multiple (for example, 3) opposite electrodes 27. Front ends of the opposite electrodes 27 are separated in a spaced manner, and face the front end side of the outer circumferential surface of the center conductor 510. In this case, the distance between one opposite electrode 27*a* and the center conductor 510 may be shorter than the distances between the other two opposite electrodes 27*b*, 27*c* and the center conductor 510. In addition, the front end of the opposite electrode 27*a* at a shorter distance from the center conductor 510 may be sharp. Through the configuration, the opposite electrode 27*a* at a shorter distance from the center conductor 510 may be used for discharging, and the other two opposite electrodes 27*b*, 27*c* may be used for heat dissipation of the discharging area.

INDUSTRIAL APPLICABILITY

As illustrated above, the present invention is applicable to a mixer for mixing a pulse voltage and an electromagnetic wave, a matching device for achieving impedance matching of an electromagnetic wave output from the mixer, an ignition unit having the mixer, and a plasma generator having the ignition unit.

LIST OF REFERENCE NUMERALS

100 Plasma generator
200 Pulse voltage generator
300 Mixer
310 First input terminal
315 Second input terminal
320 Countercurrent prevention coil (countercurrent stopping unit)
330 Condenser
340 Hybrid output terminal
360 Housing (third electrically conductive member)
362 First dielectric ring
364 Second dielectric ring
366 Dielectric pipe (insulating cylinder)
370 Electrical conductor rod (first electrically conductive member)
372 Electrical conductor pipe (second electrically conductive member)
400 Matching device
462 Inner connecting member
464 Insulator insertion member
466 Outer fixing member
468 Outer connecting member
470 Dielectric member (cylindrical insulating member)
500 Spark plug

What is claimed is:

1. A mixer, mixing energy of a pulse voltage and energy of an electromagnetic wave in the same transmission line, comprising:

a first input terminal, having an inner conductor and an outer conductor that form a coaxial structure, and for inputting the electromagnetic wave;

a second input terminal, for inputting the pulse voltage;

a hybrid output terminal, having an inner conductor and an outer conductor that form a coaxial structure, and for outputting the pulse voltage and the electromagnetic wave;

a bar-shaped first electrically conductive member, having one end electrically connected to the second input terminal and the other end electrically connected to the inner conductor of the hybrid output terminal;

a cylindrical second electrically conductive member, separated from and surrounding the first electrically conductive member in a spaced manner, configured to be coaxial with the first electrically conductive member, and electrically connected to the inner conductor of the first input terminal; and a cylindrical third electrically conductive member, separated from the second electrically conductive member, receiving the first electrically conductive member and the second electrically conductive member in a spaced manner, configured to be coaxial with the first electrically conductive member and the second electrically conductive member, and electrically connected to the outer conductor of the first input terminal and the outer conductor of the hybrid output terminal respectively.

2. The mixer according to claim 1, wherein:

the first electrically conductive member at the hybrid output terminal protrudes from an opening of the second electrically conductive member.

3. The mixer according to claim 2, wherein:

one end, at the second input terminal, of the first electrically conductive member is inside the second electrically conductive member.

4. The mixer according to claim 3, comprising:

a countercurrent stopping unit, wherein the countercurrent stopping unit electrically connects the second input terminal to the first electrically conductive member, and stops the electromagnetic wave input through the first input terminal from flowing to the second input terminal; and the countercurrent stopping unit is inserted into the inside of the second electrically conductive member, and is connected to the first electrically conductive member at the second input terminal in the inside of the second electrically conductive member.

5. The mixer according to claim 4, wherein:

the countercurrent stopping unit comprises a coil-shaped electrically conductive spring, which is retained by being compressed between the second input terminal and the first electrically conductive member.

6. An ignition unit, comprising:

a pulse voltage generator, for generating a pulse voltage;

the mixer according to claim 4, for mixing the pulse voltage output from the pulse voltage generator with an electromagnetic wave output from an electromagnetic wave source; and an electric resistance, connected between the second input terminal and the countercurrent stopping unit.

7. The mixer according to claim 1, wherein:

the inner conductor of the first input terminal is connected to the second electrically conductive member at an end portion, at the second input terminal, of the second electrically conductive member.

8. The mixer according to claim 1, comprising:

an insulating cylinder, wherein the insulating cylinder is configured between the first electrically conductive member and the second electrically conductive member to electrically insulate the first electrically conductive member from the second electrically conductive member.

9. The mixer according to claim 1, comprising:

a pair of electrically conductive cylinders, wherein the pair of electrically conductive cylinders are opposite to each other between an outer circumferential surface of the first electrically conductive member and an inner circumferential surface of the second electrically conductive member, and one of the pair of electrically conductive cylinders is electrically connected to the first electrically conductive member, and the other of the pair of electrically conductive cylinders is electrically connected to the second electrically conductive member.

10. The mixer according to claim 1, wherein:

the pulse voltage and the electromagnetic wave output through the hybrid output terminal are supplied to a discharger, the discharger comprises a center conductor electrically connected to the inner conductor of the hybrid output terminal and a grounding conductor which is electrically connected to the outer conductor of the hybrid output terminal and forms a discharge gap together with the center conductor, and the center conductor and the grounding conductor form a coaxial structure; on the other hand, the hybrid output terminal is configured so that impedance of the electromagnetic wave becomes the same as that of the discharger.

11. A matching device, achieving impedance matching of an electromagnetic wave from the mixer according to claim 1 to a discharger electrically connected to the hybrid output terminal of the mixer, wherein:

the discharger comprises a center conductor electrically connected to the inner conductor of the hybrid output terminal and a grounding conductor which is electrically connected to the outer conductor of the hybrid output terminal and forms a discharge gap together with the center conductor, and is configured so that: the center conductor and the grounding conductor form a coaxial structure, the center conductor extends along an axial direction of the hybrid output terminal, and the grounding conductor is separated from the outer conductor of the hybrid output terminal; on the other hand, the matching device comprises a cylindrical outer connecting member, and the cylindrical outer connecting member electrically connects the outer conductor of the hybrid output terminal to the grounding conductor of the discharger, and is movably disposed along an axial direction thereof.

12. The matching device according to claim 11, comprising:

a cylindrical insulating member, wherein the cylindrical insulating member is used to stop discharging from occurring between the inner conductor of the hybrid output terminal or the center conductor of the discharger and the outer connecting member.

13. The matching device according to claim 12, wherein:

the cylindrical insulating member is fixed on an inner surface of the outer connecting member.

14. The matching device according to claim 11, comprising:

an inner connecting member, wherein the inner connecting member electrically connects the inner conductor of the hybrid output terminal to the center conductor of the discharger and retains the inner conductor and the center conductor.

15. The matching device according to claim 11, wherein:

two end portions of the outer connecting member are bent inwards respectively, one end portion urges against the outer conductor of the hybrid output terminal, and the other end portion urges against the grounding conductor of the discharger or is electrically connected to a conductor of the grounding conductor.

16. A matching device, achieving impedance matching of an electromagnetic wave from a mixer mixing energy of a pulse voltage and energy of an electromagnetic wave in the same transmission line to a discharger electrically connected to a hybrid output terminal of the mixer, wherein:

the discharger comprises a center conductor electrically connected to an inner conductor of the hybrid output terminal and a grounding conductor which is electrically connected to an outer conductor of the hybrid output terminal and forms a discharge gap together with the center conductor, and is configured so that: the center conductor and the grounding conductor form a coaxial structure, the center conductor extends along an axial direction of the hybrid output terminal, and the grounding conductor is separated from the outer conductor of the hybrid output terminal; on the other hand, the matching device comprises a cylindrical outer connecting member, and the cylindrical outer connecting member electrically connects the outer conductor of the hybrid output terminal to the grounding conductor of the discharger, and is movably disposed along an axial direction thereof.

17. A plasma generator, comprising:

the ignition unit according to claim 16; and a discharger, for using the pulse voltage and the electromagnetic wave output from the ignition unit to generate plasma.

18. An ignition unit, comprising:

a pulse voltage generator, for generating a pulse voltage; and the mixer according to claim 1, for mixing the pulse voltage output from the pulse voltage generator with an electromagnetic wave output from an electromagnetic wave source.

* * * * *